United States Patent [19]

Crabtree

[11] 4,050,436

[45] Sept. 27, 1977

[54] IDLE SYSTEM BLOCKING MEANS

[76] Inventor: Roger A. Crabtree, Rte. 1, Box 471, Summerville, S.C. 29483

[21] Appl. No.: 667,845

[22] Filed: Mar. 17, 1976

[51] Int. Cl.[2] ..... F02B 77/08; F02M 3/02

[52] U.S. Cl. ..... 123/198 DB; 123/DIG. 11; 123/97 B; 261/DIG. 74; 261/41 D; 123/179 BG

[58] Field of Search .... 123/198 D, 198 DB, 198 DC, 123/DIG. 11, 973, 179 BG, 179 G, 180 E; 261/DIG. 74, 41 D

[56] References Cited

U.S. PATENT DOCUMENTS

| | | | |
|---|---|---|---|
| 2,084,426 | 6/1937 | Berry | 123/198 DB |
| 2,886,020 | 5/1959 | Wolfe | 123/198 D |
| 3,158,144 | 11/1964 | Walker | 123/198 DB |
| 3,517,653 | 6/1970 | Ariga et al. | 123/198 DB |
| 3,618,581 | 11/1971 | Simonet | 123/198 DB |
| 3,741,177 | 6/1973 | Schultz | 123/DIG. 11 X |
| 3,760,785 | 9/1973 | Harrison et al. | 123/DIG. 11 X |
| 3,788,288 | 1/1974 | Harrison et al. | 123/DIG. 11 X |

*Primary Examiner*—Ronald H. Lazarus
*Assistant Examiner*—Ira S. Lazarus
*Attorney, Agent, or Firm*—Larry Harold Kline

[57] ABSTRACT

A device is disclosed which may prevent engine dieseling, fuel waste, and reduce exhaust emissions by preventing idle system fuel mixture from entering the carburetor of a vehicle at various times.

12 Claims, 9 Drawing Figures

IDLE SYSTEM BLOCKING MEANS

This invention relates to a device for preventing engine dieseling and more particularly to a device which can prevent engine dieseling and also have fuel savings and emission reducing benefits.

The problem of engine dieseling after the engine has been shut off has been long recognized. Idle system fuel and air is pulled into the hot combustion chamber such that combustion is maintained for a few seconds or longer after the engine is shut off. The present invention solves this undesirable problem.

During engine deceleration, the high manifold vacuum developed tends to draw excessive fuel from the idle system and to interfere with the proper scavenging of exhaust gases from the combustion chamber. This results in incomplete burning and causes excess fuel use and causes excess emissions to pass into the atmosphere. The present invention also solves this problem.

An object of the present invention is to provide a device which replaces the present idle jet assembly in a carburetor.

Another object of this invention is to prevent idle system fuel from entering the carburetor when the engine is shut off.

Still another object of this invention is to provide a device which replaces the present idle jet assembly in a carburetor which is operated for anti-dieseling use and for fuel savings and emission reducing use.

Another object of this invention is to provide a device which replaces the present idle jet assembly in a carburetor which can be retro-fitted easily on existing carburetors.

Another object of this invention is to prevent fuel from entering the carburetor through the idle system when the engine is shut off by forcing a plunger into the idle fuel discharge port and thereby to prevent idle system fuel mixture from entering the carburetor.

A further object of this invention is to control the supply of energy to the force means of a blocking means for preventing idle system fuel mixture from being discharged into a carburetor.

A further object of this invention is to provide a device for positive shut-off of the idle system fuel mixture into the carburetor for a length of time controlled by time delay means.

Another object of this invention is to provide a device for positive shut-off of the idle system fuel mixture into the carburetor by a switch controlled by a vehicle ignition switch.

Another object of this invention is to provide a device for positive shut-off of idle system fuel mixture to the carburetor by use of a solenoid force means.

Still another object of this invention is to provide a device for positive shut-off of idle system fuel mixture to the carburetor by use of a diaphram force means.

These and other objects and features of the invention will be apparent from the following description and appended claims.

Briefly, the invention is a device which controls the discharge of idle system fuel mixture into a carburetor. The device comprises blocking means which is placed into the idle fuel discharge port of the carburetor. The idle system fuel mixture cannot pass the blocking means to be discharged into the carburetor. Excess idle system fuel mixture can, therefore, be prevented from entering the carburetor. This will prevent dieseling and enable fuel savings and reduction of undesirable exhaust emissions. The blocking means comprises a plunger and a force means. The plunger is operative to be placed into the idle fuel discharge port to prevent the idle system fuel mixture from passing into the carburetor. The force means is operative, when energized, to force the plunger into the idle fuel discharge port. The blocking means further comprises control means which is operative to control the time when the force means forces the plunger into the idle fuel discharge port. The blocking means may further comprise securing means operative to attach the blocking means to the carburetor. The securing means may comprise a threaded section which is screwed into the carburetor. The blocking means may further comprise adjusting means operative to vary the distance between the plunger and the idle fuel discharge port when the force means is not energized. The force means may comprise a solenoid which may be energized by electrical energy. The force means may further comprise a plunger stop, a spring to keep the plunger against against the plunger stop when the solenoid is not energized, and electrical wiring connected to the solenoid. The force means may also comprise a diaphram force means which may be energized by air pressure. The diaphram force means comprises an air pressure opening, a diaphram which under sufficient air pressure will press against the plunger, a plunger stop, and a spring to keep the plunger against the diaphram at the plunger stop when sufficient air pressure is not applied. The plunger comprises a tapered end which is placed into the idle fuel discharge port. The control means comprises a power source and switch means. The power source is operative to provide energy to the force means. The switch means is operative to connect the power source to the force means at desired times. The switch means may be controlled by the ignition switch of a vehicle. Time delay means may be connected in series with the switch means and force means. The time delay means may control the length of time energy is provided to the force means after the switch means is closed. A vacuum control switch means may connect the power source to the force means when a vacuum appears at a pre-designated point. The power source may be a vehicle battery.

The invention will be more fully understood from the following detailed description and appended claims when taken with the drawings in which:

Figure 1:
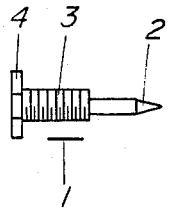
FIG. 1 is a side view of the old idle jet needle valve.

Referring now to the drawings, FIG. 1 shows an old idle jet needle valve assembly. The idle jet needle valve 1 is comprised of tapered end 2, threaded section 3, and adjusting head means 4. The quantity of idle jet fuel mixture allowed through the idle fuel discharge port may be adjusted by the adjusting head means 4.

Figure 2:
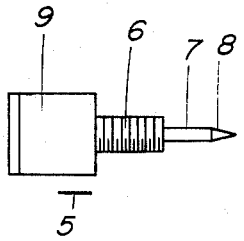
FIG. 2 is a side view of the new replacement needle valve idle assembly.

FIG. 2 is a side view of the new replacement needle valve idle assembly. New replacement needle valve 5 is comprised of force means 9, threaded section 6, plunger 7, and tapered end 8 of plunger 7. Plunger 7 moves within threaded section 6. Threaded section 6 is similar to threaded section 3 of FIG. 1 in that the outer portion is adaptable to be screwed into the same female opening, as is threaded section 3 of the old idle jet needle valve 1. The new replacement needle valve 5 is therefore adaptable to be used in any carburetor which previously used the standard old idle jet needle valve 1.

Figure 3:
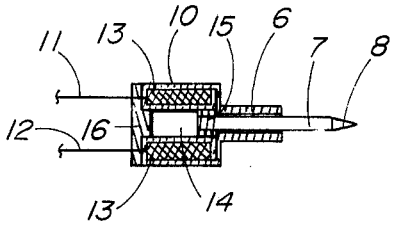
FIG. 3 is a cross-section of the side view of the new replacement needle valve idle assembly showing the force means to be a solenoid.

FIG. 3 shows a cross-sectional view of the new replacement needle valve idle assembly 5, showing the force means to be a solenoid 10. Electrical wiring 11 and 12 is shown connected to solenoid 10. The coil 13 of solenoid 10, when energized by the electrical wiring 11 and 12, acts upon plunger 7 and forces plunger 7 a pre-determined distance away from the idle assembly 5. When de-energized, plunger 7 returns to its normal position. Plunger head 14 is held against plunger stop 16 by spring 15 when the solenoid is de-energized. Plunger stop 16 may be simply the end cover of solenoid 10.

Figure 4:
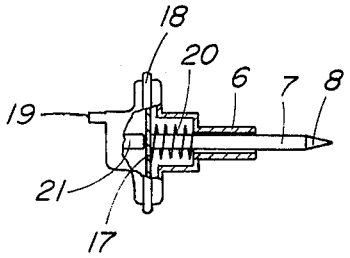
FIG. 4 is a cross-section of the side view of the new replacement needle valve idle assembly showing the force means to be an air pressure diaphram-operated device.

FIG. 4 is a cross-sectional view of the idle assembly in FIG. 2 showing the force means to be a diaphram force means 18. Air pressure may be forced through pressure opening 19 and pushed against diaphram 17, which would then press forward against plunger 7 and move plunger 7 along with tapered end 8 a predetermined distance away from the idle assembly 5. Diaphram spring 20 acts to return the device to its de-energized position when the pressure is no longer applied at pressure opening 19. When de-energized, diaphram 17 rests between plunger stop 21 and plunger 7. Plunger stop 21 acts to stop the plunger 7 when it is returned to its rest position by diaphram spring 20.

FIG. 3 shows the force means as a solenoid 10. FIG. 4 shows the force means as a diaphram force means 18. Any force means which can be used to press the plunger 7, with tapered end 8, forward a pre-determined amount could be used within the scope of this invention.

Figure 5:
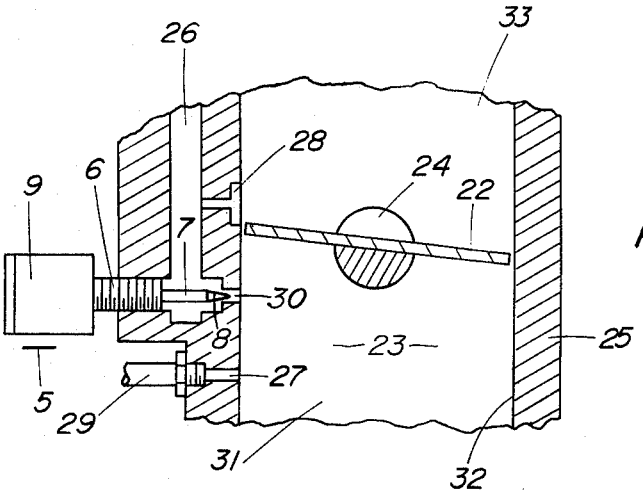
FIG. 5 is a partial cut-away of the new replacement needle valve idle assembly used in a carburetor.

FIG. 5 is a partial cut-away of the new idle assembly 5 used in a carburetor. FIG. 5 shows a typical downdraft type carburetor in which is placed the idle assembly 5. The invention is equally applicable to this invention of carburetor or to any other type of carburetor. The carburetor is shown with an upper end 33, a cylindrical bore 32, a body 25, and a lower end 31. The body portion 25, with the cylindrical bore 32, provides a conventional air-fuel induction passage 23. The upper end 33 of the carburetor is open to clean air at approximately atmospheric pressure which has passed through a conventional air cleaner, which is not shown. At the lower end 31 of the carburetor, the passage 23 may be connected to a conventional intake manifold from which the air and fuel mixture passes to the engine cylinders. The flow of air and fuel through induction passage 23 is controlled by a conventional throttle valve 22. Throttle valve 22 is fixed on shaft 24, which is mounted for rotation in the side walls of body 25 of the carburetor, in a known manner. A main fuel system is not shown since there are many known types and this invention is applicable to any fuel system. The fuel would be inducted into passage 23 from above the throttle valve 22 in a known manner as a function of the rotation of the valve. The carburetor also has an idle system using the invention of idle assembly 5, replacing the old idle jet needle assembly 1. The idle system provides the necessry fuel and air to the engine cylinders during engine idling and off idle speed operation. A by-pass passage, or fuel channel 26, contains the usual transfer port 28 and a discharge port 30, which is controlled by the tapered end 8 of plunger 7 on idle assembly 5. When the ignition is turned off, force means 9 is activated, forcing plunger 7 with tapered end 8 forward. Tapered end 8 effectively closes idle fuel discharge port 30 and prevents the idle fuel mixture from entering the combustion chamber, thereby preventing engine dieseling.

Transfer port 28 helps provide smooth transition of fuel when throttle valve 22 is opened. By use of sensing port 27 and tube 29, the manifold vacuum can be sensed and sensing means can actuate devices such as a vacuum control switch for various purposes. During engine deceleration, a high vacuum is developed in the manifold which would, under normal conditions, cause fuel to be brought in through fuel channel 26 and idle fuel discharge port 30 into the carburetor. By utilizing a system which would activate force means 9, which would press plunger 7 with tapered end 8 forward, thereby closing discharge port 30, fuel would not be allowed to flow through the idle fuel discharge port 30. The overall effect would be to lessen the emissions of unburned hydrocarbons and carbon monoxides, and other undesirable elements into the atmosphere during deceleration operations, as well as saving fuel.

Many sections of the fuel system and engine are not shown in the drawings as they are well known and the present invention will work with any of these well known systems.

Figure 6:
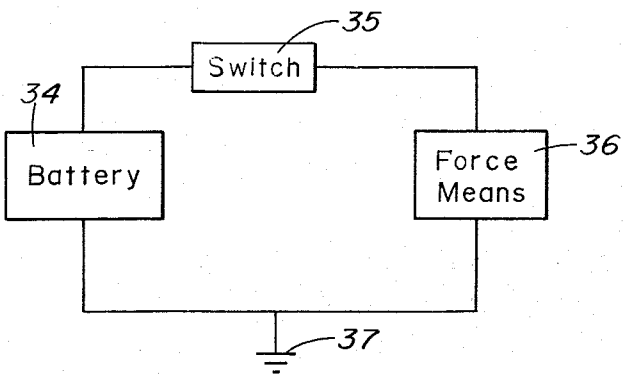
FIG. 6 is a black box circuit diagram for use with the invention with simple switch means for anti-dieseling use.

FIG. 6 is a black box circuit diagram which can be used with the invention. FIG. 6 shows battery 34 connected to switch 35. Switch 35 is connected to force means 36. The battery 34 and force means 36 are connected to ground 37, completing the circuit. Switch 35 may be a push button placed on the dashboard inside the vehicle, or any other type of simple switch which can simply close the circuit, giving current to the force means 36, thereby activating the force means 36 to force the plunger 7 with tapered end 8 into the idle fuel discharge port 30 in order to prevent idle system fuel mixture from entering the carburetor. This circuit may be used for anti-dieseling use. When the vehicle is dieseling, the operator of the vehicle may activate the switch by pressing a button or otherwise, and thereby stop the dieseling.

Figure 7:
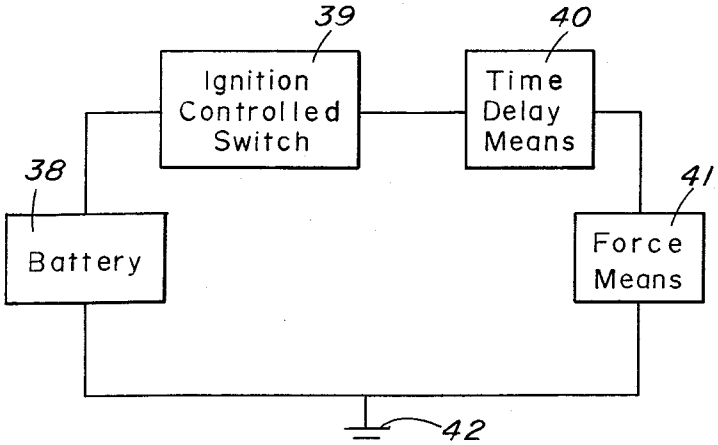
FIG. 7 is a black box circuit diagram for use with the invention for anti-dieseling use only, incorporating an ignition control switch and time delay means.

FIG. 7 is a black box circuit diagram which can be used with the invention for anti-dieseling use. Battery 38 is connected to ignition control switch 39 which is connected to time delay means 40. Time delay means 40 is connected to force means 41. Battery 38 and force means 41 are connected to ground 42 to complete the circuit. The ignition control switch may activate relays, or may contain any type of circuitry which completes the circuit between battery 38 and time delay means 40 when desired. The time delay may be accomplished by an electronic timer, a mechanical timer, a vacuum sensitive switch connected to the intake manifold, or pressure sensitive switch connected to the oil system of the engine, or any other time delay sensing device. When the ignition is turned off, the ignition controlled switch connects battery 38 to time delay means 40, thereby energizing the force means 41 causing the idle fuel to be cut off as previously described. Delay means 40 de-energizes the force means 41 by opening the circuit a pre-determined time after it has first been completed.

Figure 8:
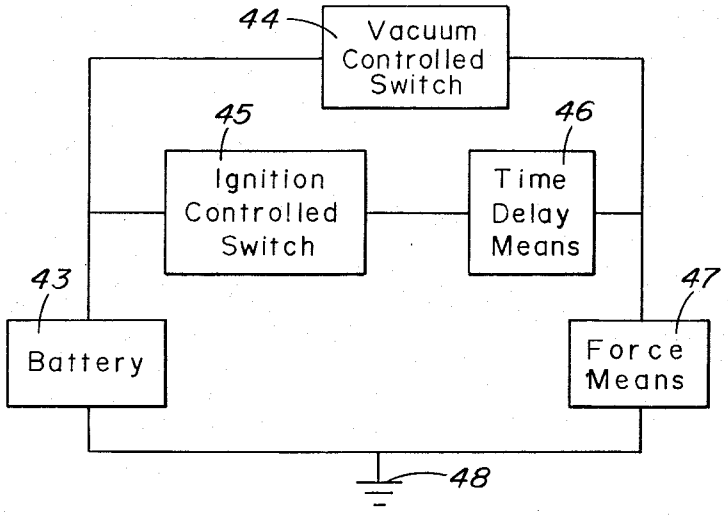
FIG. 8 is a black box circuit diagram for use with the invention for combined use for anti-dieseling and fuel savings and emission reduction purposes utilizing a vacuum control switch, ignition control switch and time delay means.

FIG. 8 is a black box circuit diagram which can be used with the invention for combined anti-dieseling and fuel savings, and emission reduction purposes. Battery 43 is connected to one side of vacuum controlled switch 44 which is in parallel with ignition controlled switch 45 and time delay means 46, which are in series with each other. Force means 47 is connected to the other side of vacuum controlled switch 44 which is in parallel with ignition controlled switch 45 and time delay means 46. Force means 47 and battery 43 are connected to ground 48 to complete the circuit. Under dieseling conditions, the vacuum controlled switch would be open and the circuit would be similar to the circuitry of FIG. 7, and the ignition controlled switch 45 would act as ignition controlled switch 39 which was previously described. The time delay means 46 would act as the time delay means 40 which was previously described. During engine deceleration, the high vacuum in the intake manifold would cause the vacuum controlled switch to close and complete the circuit between battery 43 and force means 47. This would result in the force means 47 being activated and the idle jet fuel being cut off from the carburetor, as previously explained. The result would be fuel savings and a reduction of exhaust emissions, as previously described. The vacuum could be sensed through manifold vacuum sensing port 27 and through tube 29, as shown in FIG. 5.

Figure 9:
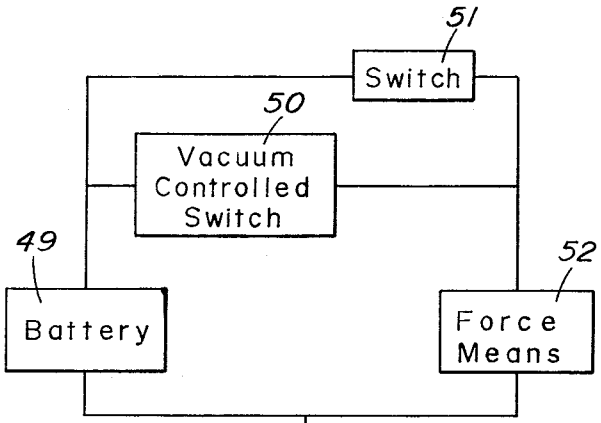
FIG. 9 is a black box circuit diagram for use with the invention for simplified operation for anti-dieseling purposes combined with automatic operation for fuel savings and emission reduction purposes.

FIG. 9 is a block box circuit diagram which can be used with this invention. Battery 49 is connected to one side of vacuum controlled switch 50 and switch 51, which are in parallel. Force means 52 is connected to the other side of vacuum controlled switch 50 and switch 51. Force means 52 and battery 49 are connected to ground 53 to complete the circuit. During dieseling conditions, vacuum controlled switch 50 is open and is effectively eliminated from the circuit. Switch 51 may be activated, as was switch 35 in FIG. 6, in order to eliminate the dieseling.

During deceleration conditions, switch 51 would be open and effectively eliminated from the circuit. Vacuum controlled switch 50 would act the same as vacuum controlled switch 44 in FIG. 8, in order to reduce exhaust emissions and effectively save fuel during engine deceleration.

In all cases, when the force means is energized, the plunger 7 with tapered end 8 effectively closes idle fuel discharge port 30 and cuts off the flow of idle system fuel mixture into the carburetor.

Adjusting head means 4 in FIG. 1 can be used for the adjustment of idle assembly 5. The head means can be indented so that it may be turned with a screwdriver. Idle assembly 5 may also be adjusted by simply turning the force means 9 by hand, or with any desired tool. The initial adjustments would be similar to present adjustments for old idle jet needle valve 1. The threaded section 6 in idle assembly 5, which is similar to threaded section 3 in the old idle jet needle valve 1, acts as securing means to secure the idle assembly 5 to the carburetor. The plunger 7 with tapered end 8 acts as blocking means to prevent idle system fuel mixture from entering the carburetor to prevent dieseling, and to enable fuel savings and reduce undesirable exhaust emissions.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device which may be attached to an existing carburetor and which controls the discharge of idle system fuel mixture into said carburetor comprising blocking means placed into the idle fuel discharge port of said carburetor whereby idle system fuel mixture cannot pass said blocking means to be discharged into said carburetor; a power source; switch means responsively closed at ignition turn-off, operative to activate said blocking means through said power source simultaneously with ignition turn-off whereby excess idle system fuel mixture can be prevented from entering said carburetor to prevent engine dieseling; and time delay means connected in a series circuit with said power source and said switch means, operative to control the length of time said series circuit is closed after said switch means is closed responsive to the turn-off of said ignition, whereby said device prevents engine dieseling by holding said blocking means within said idle fuel discharge port for a pre-determined time after said ignition is turned off, and then opening said series circuit by said time delay means, after said pre-determined time, thereby removing said blocking means from said idle fuel discharge port.

2. A device according to claim 1 whereby said blocking means comprises:

a. a plunger operative to be placed into said idle fuel discharge port to prevent said idle system fuel mixture from passing into said carburetor; and b. force means operative when energized to force said plunger into said idle fuel discharge port;

Whereby excess idle system fuel mixture can be prevented from entering said carburetor to prevent dieseling and to enable fuel savings and reduce undesirable exhaust emissions.

3. A device according to claim 2 wherein said blocking means further comprises securing means operative to attach said blocking means to said carburetor.

4. A device according to claim 3 wherein said securing means comprises a threaded section which is screwed into said carburetor.

5. A device according to claim 3 wherein said blocking means further comprises adjusting means operative to vary the distance between said plunger and said idle fuel discharge port when said force means is not energized.

6. A device according to claim 2 wherein said force means comprises a solenoid which may be energized by electrical energy.

7. A device according to claim 2 wherein said force means comprises a diaphram force means which may be energized by air pressure.

8. A device according to claim 6 further comprising a plunger stop, a spring to keep said plunger against said plunger stop when said solenoid is not energized, and electrical wiring connected to said solenoid.

9. A device according to claim 7 wherein said diaphram force means comprises an air pressure opening, a diaphram, which under sufficient air pressure, will press against said plunger, a plunger stop, and a spring to keep said plunger against said diaphram at said plunger stop when sufficient air pressure is not applied.

10. A device according to claim 2 wherein said plunger comprises a tapered end which is placed into said idle fuel discharge port to prevent said idle fuel mixture from passing into said carburetor.

11. A device according to claim 2 further comprising a vacuum controlled switch means which is operative to connect said power source to said force means when a vacuum appears at a pre-designated point.

12. A device according to claim 2 wherein said power source is a vehicle battery.

* * * * *